US005648698A

United States Patent [19]

Makishima et al.

[11] Patent Number: 5,648,698

[45] Date of Patent: Jul. 15, 1997

[54] FIELD EMISSION COLD CATHODE ELEMENT HAVING EXPOSED SUBSTRATE

[75] Inventors: Hideo Makishima; Keizo Yamada; Hironori Imura, all of Tokyo, Japan

[73] Assignee: NEC Corporation, Tokyo, Japan

[21] Appl. No.: 460,065

[22] Filed: Jun. 2, 1995

Related U.S. Application Data

[62] Division of Ser. No. 225,976, Apr. 12, 1994, Pat. No. 5,559,390.

[30] Foreign Application Priority Data

Apr. 13, 1993 [JP] Japan ..... 5-085825

[51] Int. Cl.[6] ..... H01J 1/30

[52] U.S. Cl. ..... 313/309; 313/336

[58] Field of Search ..... 313/307, 308, 313/309, 336, 351

[56] References Cited

U.S. PATENT DOCUMENTS

| | | | |
|---|---|---|---|
| 3,998,678 | 12/1976 | Fukase et al. . | |
| 4,766,340 | 8/1988 | van der Mast et al. | 313/309 |
| 4,874,981 | 10/1989 | Spindt | 313/309 |
| 5,164,632 | 11/1992 | Yoshida et al. | 313/309 |
| 5,278,472 | 1/1994 | Smith et al. | 313/309 |
| 5,281,890 | 1/1994 | Kane | 313/309 |
| 5,315,206 | 5/1994 | Yoshida | 313/309 |
| 5,340,997 | 8/1994 | Kuo | 313/309 |
| 5,401,676 | 3/1995 | Lee | 313/311 |

FOREIGN PATENT DOCUMENTS

| | | |
|---|---|---|
| 57-187849 | 11/1982 | Japan . |
| 4-167324 | 6/1992 | Japan . |
| 4-284325 | 10/1992 | Japan . |

OTHER PUBLICATIONS

C.A. Spindt et al., "Physical properties of thin-film field emission cathodes with molybdenum cones," *Journal of Applied Physics*, vol. 47, No. 12, Dec. 1976, pp. 5248–5263.

*Primary Examiner*—Sandra L. O'Shea
*Assistant Examiner*—Matthew J. Esserman
*Attorney, Agent, or Firm*—Burns, Doane, Swecker & Mathis, LLP

[57] ABSTRACT

A field emission cold cathode element having a conducting substrate, a dielectric layer which is on the substrate and has holes, emitter electrodes which have a sharp-pointed tip and stand on the substrate in the respective holes in the dielectric layer, and a gate electrode which is on the dielectric layer and has apertures right above the respective holes in the dielectric layer. The tip of each emitter electrode is near or in the aperture in the gate electrode layer. The dielectric layer is largely removed so as to remain only in limited regions around the holes for the respective emitter electrodes, and a gate electrode layer is formed with, in addition to the apertures for the emitter electrodes, a number of holes in regions where the substrate surface is exposed by removal of the dielectric layer. The partial removal of the dielectric and gate electrode layers has the effect of reducing interlayer stresses induced by temperature changes, so that the gate electrode layer can be made desirably thick.

8 Claims, 4 Drawing Sheets

FIELD EMISSION COLD CATHODE ELEMENT HAVING EXPOSED SUBSTRATE

This application is a divisional of application Ser. No. 08/225,976, filed Apr. 12, 1994, now U.S. Pat. No. 5,559, 390.

BACKGROUND OF THE INVENTION

This invention relates to a field emission cold cathode element having at least one minute emitter electrode with a sharp-pointed tip which is close to a gate electrode and from which electrons are emitted.

It is known, as described in Journal of Applied Physics, Vol. 47, No. 12 (1976), pp. 5248–5263, to produce a field emission cold cathode element by forming an array or arrays of a number of microscopically minute and conical emitter electrodes on a conducting substrate. The cold cathode element is fabricated by forming a dielectric layer on the conducting substrate, overlaying the dielectric layer with an electrode layer, for each emitter electrode forming a hole in the electrode layer, through that hole etching the dielectric layer to expose the substrate surface beneath the hole and growing a conical emitter electrode on the exposed substrate surface by a physical vapor deposition method until the tip of the conical emitter electrode nears or protrudes into the hole in the electrode layer. The electrode layer on the dielectric layer becomes a gate electrode for drawing the current emitted from every emitter electrode and controlling the emission current. Usually a voltage of 100–300 V is applied between the gate electrode and the substrate to which the emitter electrodes make electrical connection.

In this cathode element the conical emitter electrodes are about 1 μm in height (the dielectric layer is about 1 μm in thickness), and the hole in the gate electrode layer for each emitter is about 1 μm in diameter. Since the sharp-pointed tip of each emitter electrode is so close to the gate electrode a strong electric field acts at the emitter electrode tip, and electrons are emitted from the emitter tip when the field intensity reaches 2 to $5\times10^7$ V/cm. A large number of identical emitter electrodes are arranged on the substrate in closely packed arrays to provide a planar cold cathode element that can emit a large current. Compared with conventional hot cathode elements, this cold cathode element has advantages such as higher current densities and less fluctuations of the velocity of emitted electrons. Furthermore, by comparison with conventional field emission cathode elements having a single, relatively large emitter electrode, this cathode element has advantages such as reduced current noises, lower gate voltages for useful emission and operability in lower vacuums.

With respect to each conical emitter electrode in the above described cold cathode element the emission current depends greatly on the position of the emitter electrode tip relative to the gate electrode and, hence, on the height of the emitter electrode. In the cathode element having a large number of conical emitter electrodes, some dispersion of emitter electrode heights is inevitable, and hence there are some variations in the emission characteristics of the individual emitter electrodes. When the variations are considerable, the maximum emission current of the cathode element must be reduced since the maximum emission current is restricted by the allowable maximum emission characteristic of one emitter electrode which makes the highest emission at a given voltage. An previously already known measure for reducing variations in the emission currents is to make the gate electrode layer relatively thick such that the position of the tip of each emitter electrode becomes above the middle plane of the gate electrode layer.

However, another problem is augmented by thickening the gate electrode layer. The problem arises from temperature changes which the cathode element experiences during the manufacturing process. In confining the cathode element in a vacuum enclosure, it is necessary to discharge gases that are adsorbed by the cathode element and other components in the vacuum enclosure in order that the cathode element can be long operated in high vacuum. Usually the gases are extracted while the interior of the enclosure is maintained at a temperature above 500° C. The heating to such a high temperature and subsequent cooling induce interlayer stresses between the gate electrode layer and the underlying dielectric layer since the two layers differ in thermal expansion coefficients, and the stresses increase as the gate electrode layer becomes thicker.

From another aspect, for extending the life of the above described cathode element and enhancing the reliability of same, it is desirable that the material of the gate electrode layer has a high melting point and is refractory because there are possibilities of collisions of a portion of electrons emitted from the emitter electrodes or electrons reflected from other electrodes in the vacuum enclosure against the gate electrode and occurrence of micro-discharges between the gate electrode and the emitter electrodes. However, conducting and desirably refractory materials are generally greatly different in thermal expansion coefficients from silicon dioxide which is usually used for the dielectric layer under the gate electrode layer. Therefore, the aforementioned stresses further increase when the gate electrode layer is formed of a refractory material and made sufficiently thick.

With respect to the gate electrode in field emission cold cathode elements of the above described type, there are several proposals.

JP 4-167324 A proposes a two-layer structure of the gate electrode, consisting of a first gate layer which is a polycrystalline silicon layer formed directly on the dielectric layer and a second gate layer which is a metal silicide layer formed on the polycyrstalline silicon layer. The second gate layer of a metal silicide, which is very high in melting point, is employed with the intention of preventing lowering of the resistivity of the gate electrode by oxidation and deformation of the gate electrode in the vicinity of each emitter electrode. The metal silicide layer is underlaid with the polycrystalline silicon layer to ensure good adhesion of the gate electrode to the dielectric layer. However, if this two-layer gate electrode is made sufficiently thick significant stresses will be induced by different thermal expansions between the gate electrode and the dielectric layer and also between the first and second gate layers.

JP 4-284325 A also proposes a two-layer structure consisting of a usual gate electrode layer and an upper, protective layer formed of a conducting material excellent in corrosion resistance. This reference shows a three-layer structure produced by inserting a thin layer between the above two-layer gate electrode and the dielectric layer in order to improve adhesion. However, such multilayering leads to increased interlayer stresses.

JP 57-187849 A shows forming a small, annular gate electrode for each of a number of conical emitter electrodes to thereby control the emssion currents of the emitter electrodes individually. Since the dielectric layer below the gate electrodes is formed over the entire area of the substrate (though it is removed in narrow circular regions where the respective emitter electrodes are formed), the formation of the small annular gate electrodes results in that the dielectric layer is exposed over the major area. Therefore, in operation of the cathode element in a vacuum, it is likely that the deposition of electrons and ions on the dielectric layer causes changes in the potential at the plane of the dielectric layer surface and resultant variations in the trajectories of electron beams emitted from the emitter electrodes.

SUMMARY OF THE INVENTION

It is an object of the present invention to provide a field emission cold cathode element having at least one sharp-pointed emitter electrode, which is improved in the structure of the gate electrode so that interlayer stresses induced by temperature changes are reduced or relaxed together with a reduction in a variation in the emission current of each emitter electrode attributed to a variation in the height of the emitter electrode.

It is a further object of the invention to improve endurance of the gate electrode to high temperatures without augmenting the aforementioned interlayer stresses.

A field emission cold cathode element according to the invention comprises a substrate having a conducting surface, at least one emitter electrode which stands on the conducting surface of the substrate and has a sharp-pointed tip, a dielectric layer which is formed on the surface of the substrate and, for each emitter electrode, is formed with a hole such that the emitter electrode stands in the hole, and a gate electrode layer which is formed on the dielectric layer and, for each emitter electrode, is formed with an aperture which is right above and contiguous to the hole in the dielectric layer.

According to the invention, the gate electrode layer is made relatively thick in a limited region surrounding the aperture for each emitter electrode and relatively thin in other regions.

In the limited region, which is a generally annular region, the gate electrode layer can be made so thick as to compensate variations in the height of the emitter electrode. Therefore it is possible to improve uniformity of the emission current. In the other regions, which are major regions, the gate electrode layer can be made very thin so that the interlayer stresses induced by different thermal expansions of the gate electrode layer and the dielectric layer can be reduced or relaxed. Accordingly, in practical operations the cold cathode element does not suffer from cracking or local peeling. Furthermore, a widened selection can be made for the gate electrode material, and it becomes possible even to select a conducting material that is good in refractoriness but is not close to the material of the dielectric layer in thermal expansion.

The invention includes a two-layer structure of the gate electrode only in a limited region surrounding the aperture for each emitter electrode. That is, a relatively thin gate electrode layer is overlaid with a supplementary gate electrode layer only in the limited region. In this case the supplementary gate electrode layer can be formed of a refractory material whereas the gate electrode layer in direct contact with the dielectric layer can be formed of another material having an expansion coefficient close to that of the dielectric material. Therefore, besides the above described effects of the local thickening, the gate electrode is improved in high-temperature endurance, reliability and life.

Also according to the invention, a uniformly and sufficiently thick gate electrode layer is partly or largely removed together with the underlying dielectric layer except in limited regions necessary for applying a gate voltage to the emitter electrodes. Although the gate electrode layer is made sufficiently thick, the interlayer stresses attributed to different thermal expansions of the gate electrode and dielectric layers are reduced since the contact area between the two layers and the total volume of the two layers are greatly decreased.

DESCRIPTION OF THE PREFERRED EMBODIMENTS

Figure 1:
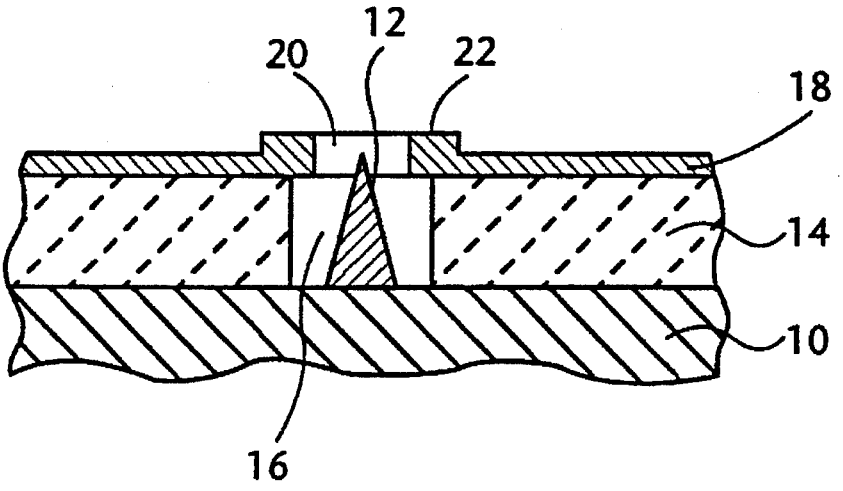
FIG. 1 is an elavational sectional view of a principal part of a field emission cold cathode element as a first embodiment of the invention.

FIG. 1 shows the fundamental structure of a field emission cold cathode element which is a first embodiment of the invention. The cathode element has a substrate 10 which is conducting at least in a surface layer. That is, either a single sheet of a conducting material or a sheet of a dielectric material such as glass or ceramic coated with a metal film can be used as the substrate 10. An emitter electrode 12, which is in the shape of a cone and has a sharp-pointed tip, stands on the conducting surface of the substrate 10 and at the base of the cone makes electrical connection with the substrate 10. The conical emitter electrode 12 is a minute electrode: usually it is smaller than 1 μm in the diameter at the base and about 1 μm in height. There is a dielectric layer 14 on the substrate 10, and the dielectic layer 14 is locally removed so as to form a hole 16 in which the conical emitter 12 stands. A gate electrode layer 18 is formed on the dielectric layer 14 and locally removed so as to form a hole 20 which is in alignment with and contiguous to the hole 16 in the dielectric layer 14. The conical emitter 12 and the holes 16, 20 in the dielectric and gate electrode layers 14, 18 are formed such that the tip of the emitter 12 becomes close to the gate electrode edge defining the hole 20. In most cases it is suitable that the position of the tip of the emitter 12 is between the lower and upper planes of the gate electrode layer 18, and preferably above the middle plane of the electrode layer 18. According to the invention, in a narrow annular region 22 around the hole 20, the gate electrode layer 18 is made thicker than in the remaining major region. In other words, the gate electrode layer 18 is made relatively thin except in the annular region 22.

Usually the cold cathode element of FIG. 1 is fabricated by first forming the dielectric layer 14 on the substrate 10 and the gate electrode layer 18 on the dielectric layer 14, then forming the hole 20 in the electrode layer 18 and etching the dielectric layer 14 by using the hole 20 in the electrode layer 18 to thereby form the hole 16 in the dielectric layer 14 and finally forming the conical emitter electrode 12 by physical vapor deposition of a suitable metal such as, e.g., molybdenum on the substrate surface exposed by the hole 16. However, it is optional to employ a different process. For example, the conical emitter 12 may be formed by etching a metal substrate (10) before forming the dielectric layer 14. The gate electrode layer 18 can be made relatively thick only in the annular region 22 by first depositing a relatively thin electrode layer over the entire area and then performing supplementary deposition only in a circular region which turns into the annular region 22 when the hole 20 is formed, or alternatively by first forming a relatively thick electrode layer and then etching the relatively thick layer to a desired depth except in the aforementioned circular region.

The cold cathode element of FIG. 1 may have a number of identical emitter electrodes (12) for each of which the dielectric and gate electrode layers 14, 18 are holed as shown in FIG. 1 and the gate electrode layer 18 is locally thickened as shown at 22 in FIG. 1.

In normal operation of the cold cathode element of FIG. 1 the emitter electrode 12 is at the same potential as the conducting substrate 10, and a positive voltage of $10^1$ to $10^2$ volts is applied to the gate electrode 18. A strong electric field acts on the tip of the emitter electrode 12 since the tip is sharp-pointed and is positioned very close to the gate electrode 18, and hence electrons are emitted from the tip of the emitter 12.

Figure 2:
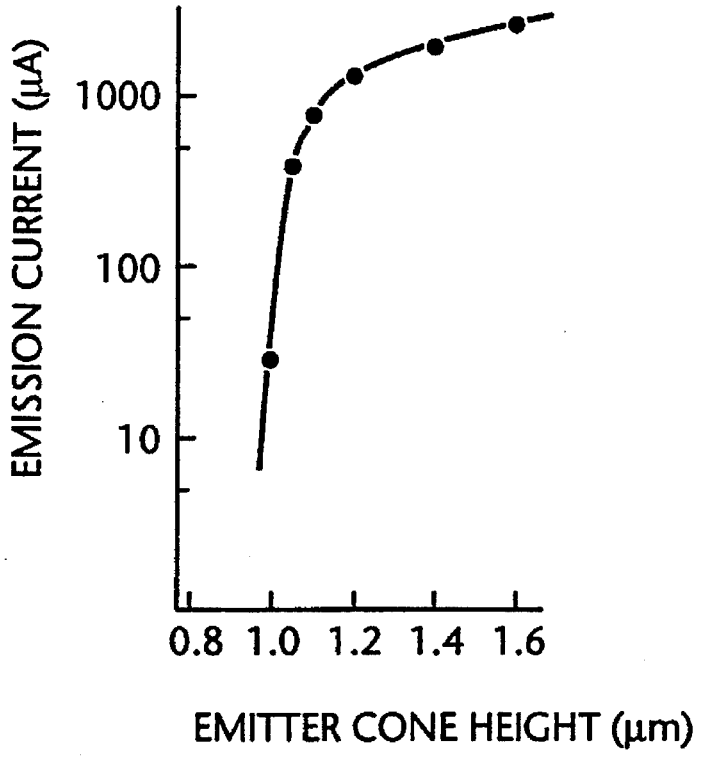
FIG. 2 is a graph showing the dependence of the emission current of the cathode element of FIG. 1 on the height of the conical emitter electrode.

It is known that the emission current that can be drawn from the single emitter 12 in FIG. 1 depends on the position of the emitter tip relative to the gate electrode 18. By calculation with respect to an example case wherein the dielectric layer 14 has a thickness of 1.0 μm and the gate electrode layer 18 a thickness of 0.4 μm in the region 22 around the aperture 20, the relationship between the height of the conical emitter 12 and the emission current obtained at a gate voltage of 100 V is as shown in FIG. 2. When the emitter height is below 1.0 μm, meaning that the emitter tip is below the lower plane of the gate electrode layer 18, a 0.1 μm change in the emitter height causes about 120% change in the emission current. However, when the emitter height is higher than 1.2 μm so that the emitter tip nears the upper plane of the gate electrode layer 18, the degree of a change in the emission current with a 0.1 μm change in the emitter height decreases to about 20%. Presumably this is because the density of unipotential planes reduces within the aperture 20 in the gate electrode layer 18. Therefore, thickening of the gate electrode layer is effective for a reduction in a variation in the emission current attributed to an unintended variation in the height of the emitter electrode 12, and this effect is particularly important for a cold cathode element having a number of emitter electrodes. From another aspect, by thickening the gate electrode layer it is possible to expand a tolerable range of dispersion of the emitter electrode heights.

In this embodiment of the invention the gate electrode layer 18 is made sufficiently thick in the narrow region 22 around the gate aperture 20 for each emitter 12 in order to gain the above explained effect. In the remaining major region the gate electrode layer 18 serves as a mere conductor and, hence, is made relatively thin to thereby relax the stresses attributed to the different thermal expansions of this layer 18 and the underlying dielectric layer 14.

Figure 3:
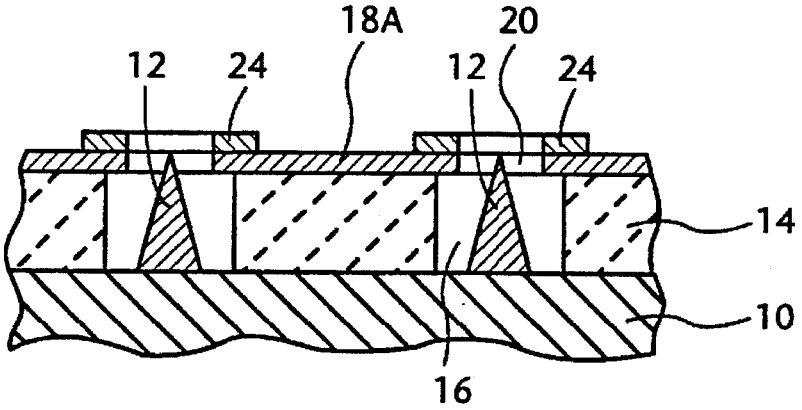
FIGS. 3 and 4 show a second embodiment of the invention in sectional and plan views, respectively.
Figure 4:
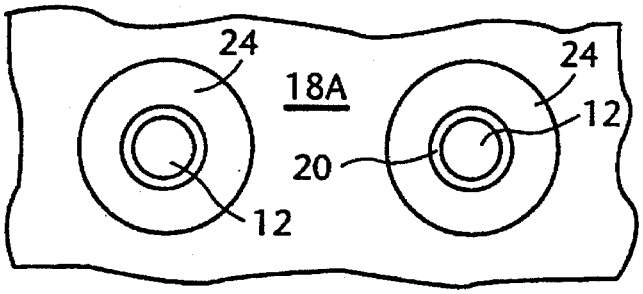

FIGS. 3 and 4 show a second embodiment of the invention. In this embodiment the substrate 10, each of conical emitter electrodes 12 and the dielectric layer 14 are similar to the counterparts in the first embodiment. As a different feature, the gate electrode is made up of a first gate layer 18A which is a relatively thin layer formed directly on the dielectric layer 14 and has a hole 20 for each emitter electrode 12 and a second gate layer 24 which is formed on the first gate layer 18A only in a narrow annular region around the hole 20. The first layer 18A is formed of a conducting material having a thermal expansion coefficient not greatly different from that of the dielectric layer 14, and the second layer 24 is formed of another conducting material having a melting point considerably higher than that of the material of the first layer 18A. For example, the substrate 10 is of silicon of which the coefficient of linear expansion is $3.1\times10^{-6}$/°C., the dielectric layer 14 is formed of silicon dioxide of which the coefficient of linear expansion is $1.5\times10^{-6}$/°C., the first gate layer 18A is formed of polycrystalline silicon of which the coefficient of linear expansion is $3.1\times10^{-6}$/°C., and the second gate layer 24 is formed of tungsten silicide $WSi_2$ (coefficient of linear expansion: $8.4\times10^{-6}$/°C.) having a melting point of about 2600° C. which is far higher than the melting point of polycrystalline silicon, about 1400° C.

This gate electrode is relatively thick in the annular region (where the second gate layer 24 exists) around each emitter electrode 12 and relatively thin in the remaining major region of the first gate layer 18A. In this regard this gate electrode is analogous to the gate electrode layer 18 in FIG. 1 and has the same merits. Furthermore, by the employment of the second gate layer 24 of a high melting point material the high-temperature endurance of the gate electrode is enhanced in the region around each gate aperture where there are strong possibilities of micro-discharges between the emitter and the gate and bombardments by negative ions produced by collisions of electrons with residual gas molecules. In the remaining major region the stresses induced by temperature changes are further reduced since the material of the first gate layer 18A is not greatly different in thermal expansion from the material of the dielectric layer 14.

On the same principle as the gate electrode of FIGS. 3 and 4 it is possible to produce a gate electrode consisting of three or more layers which are formed of three or more different materials, respectively.

Figure 5:
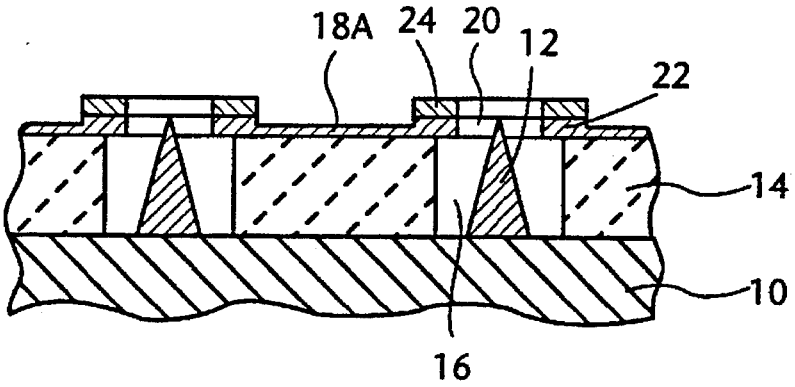
FIGS. 5 and 6 show a third embodiment of the invention in sectional and plan views, respectively.
Figure 6:
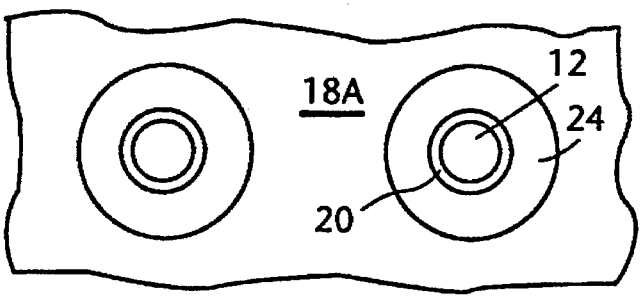

FIGS. 5 and 6 show a modification of the gate electrode in FIGS. 3 and 4. In this case the thickness of the first gate layer 18A is reduced except in an annular region 22 beneath each second gate layer 24. That is, this first gate layer 18A resembles the gate electrode layer 18 in FIG. 1. The thickness reduction in the major region of the gate electrode layer has the effect of further reducing or relaxing the stresses attributed to different thermal expansions.

Figure 7:
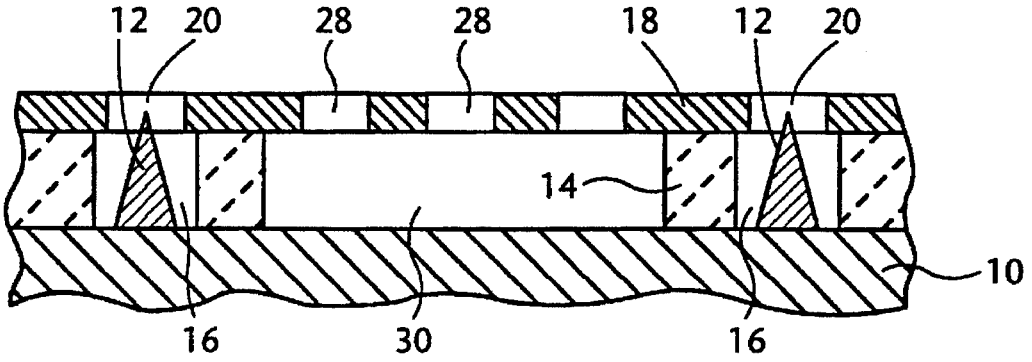
FIGS. 7 and 8 show a different embodiment of the invention in sectional and plan views, respectively.
Figure 8:
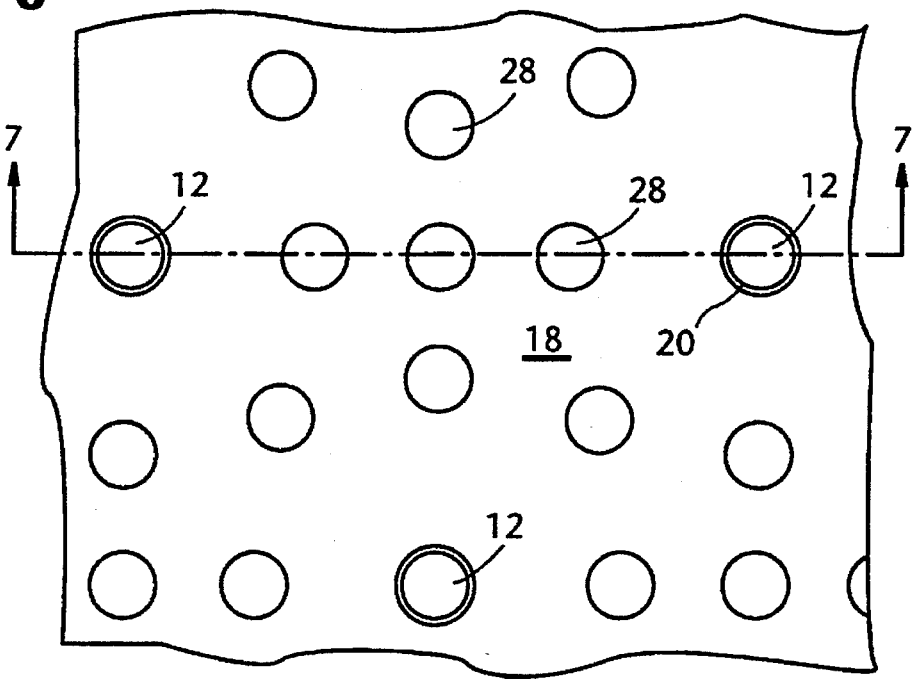

FIGS. 7 and 8 show an embodiment of another thought of the invention. FIG. 7 is a sectional view taken along the line 7—7 in the plan view of FIG. 8. Also in this case each emitter electrode 12 stands in a hole 16 in the dielectric layer 14, In this case the gate electrode is a single layer 18 which is a uniformly and sufficiently thick layer. Right above each hole 16 in the dielectric layer 14 the gate electrode layer 18 has a hole 20 into which the tip of the emitter electrode 12 protrudes. Besides, in the major region, the gate electrode layer 18 is formed with a number of apertures 28, and by using these apertures 28, the underlying dielectric layer 14 is etched so as to produce relatively large cavities 30. Consequently, the dielectric layer 14 is left only in relatively narrow annular regions around the holes 16 for the respective emitter electrodes 12.

The formation of a number of apertures 28 in the gate electrode layer 18 means removal of a considerable part of the electrode layer 18, and a large part of the dielectric layer 14 is removed as described above. Therefore, the stresses induced between the gate electrode layer 18 and the dielectric layer 14 by temperature changes are greatly reduced even though the gate electrode layer 18 is made desirably thick. Furthermore, the removal of a large part of the dielectric layer 14 has the effect of reducing stresses induced between this layer 14 and the substrate 10. Although the gate electrode, layer 18 is partly removed by forming the apertures 28, there is no possibility that through these apertures 28 charged particles such as electrons and ions will adhere to the dielectric layer 14 and affect the potential at the upper plane of the dielectric layer since the dielectric layer is removed not only in the regions right beneath the respective apertures 28 but also in laterally adjacent and wider regions.

Still further, the partial removal of the dielectric layer 14 brings about a reduction in the electrostatic capacitance between the emitter electrodes 12 and the gate electrode 18. Accordingly it becomes possible to employ a desirably high frequency in a signal which is to be applied between the emitters 12 and the gate electrode 18 in order to control the emission current, and therefore a driving amplifier for producing that signal can be simplified.

Figure 9:
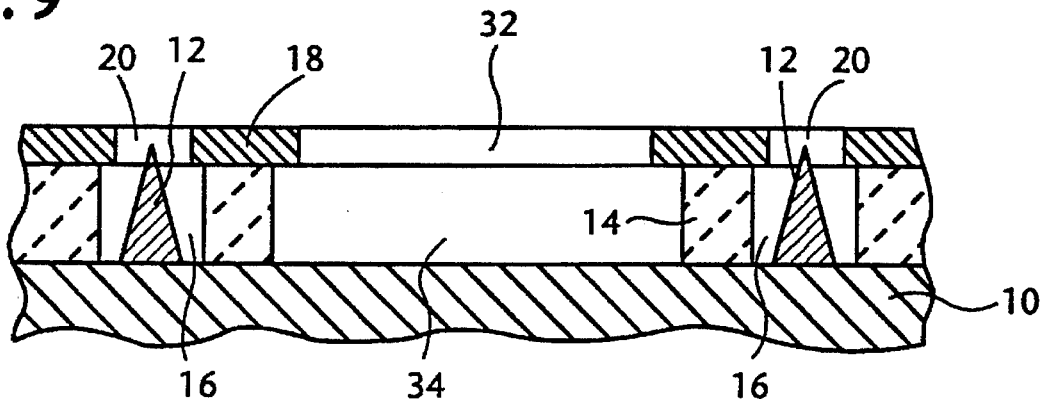
FIGS. 9 and 10 show another embodiment of the invention in sectional and plan views, respectively.
Figure 10:
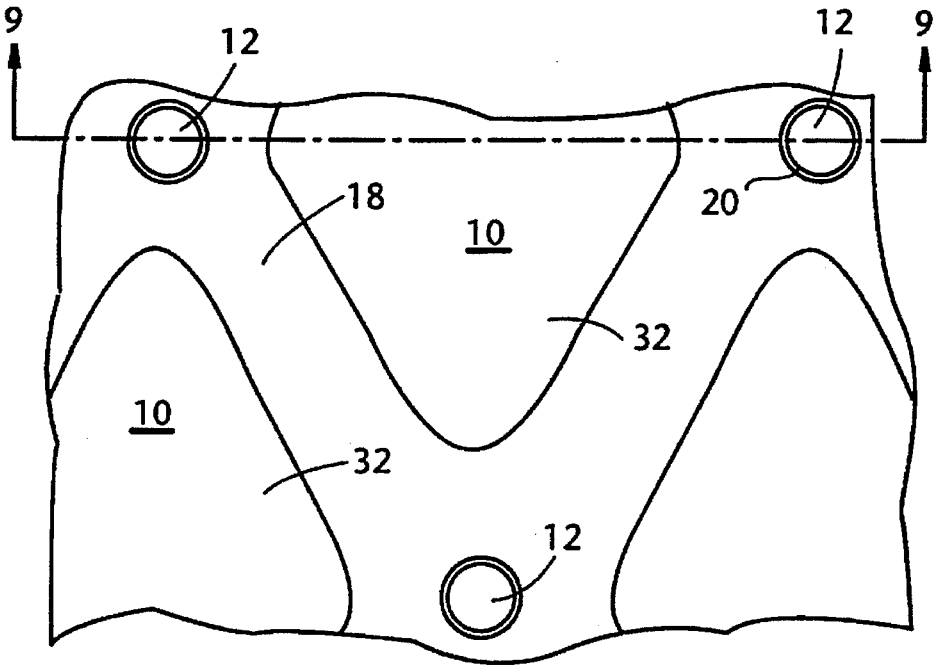

FIGS. 9 and 10 show another embodiment of the same thought. FIG. 9 is a sectional view taken along the line 9—9 in the plan view of FIG. 10. In this case too the gate electrode is a single layer 18 which is a uniformly and sufficiently thick layer. The gate electrode layer 18 is removed in relatively wide regions 32 such that the electrode layer 18 remains only in narrow regions around the respective emitter electrodes 12 and elongate regions necessary for connection of the aforementioned narrow regions with each other. In the regions 32 where the gate electrode layer 18 is removed, the dielectric layer 14 is also removed so as to produce large cavities 34. This structure has fundamentally the same advantages as the structure shown in FIGS. 7 and 8, and in this case the advantages further enhanced since larger parts of the gate electrode layer 18 are omitted.

Figure 11:
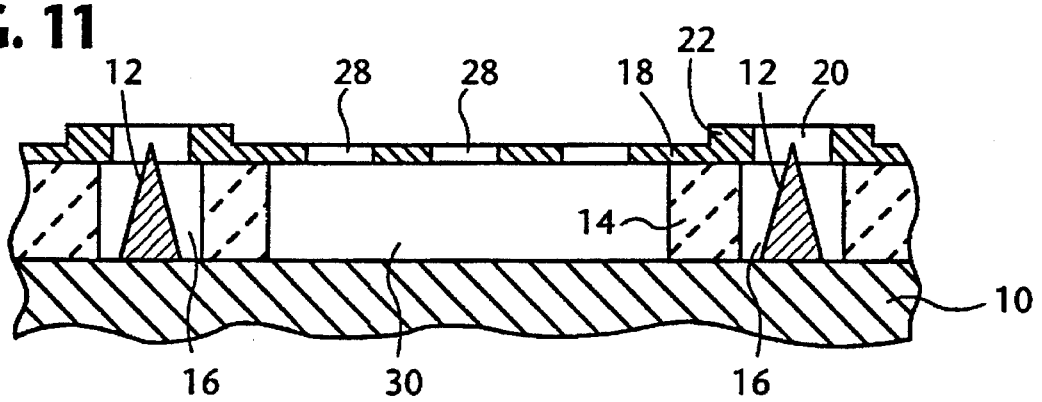
FIG. 11 shows a modification of the gate electrode in the cathode element of FIGS. 7 and 8 in a sectional view similar to FIG. 7.
Figure 12:
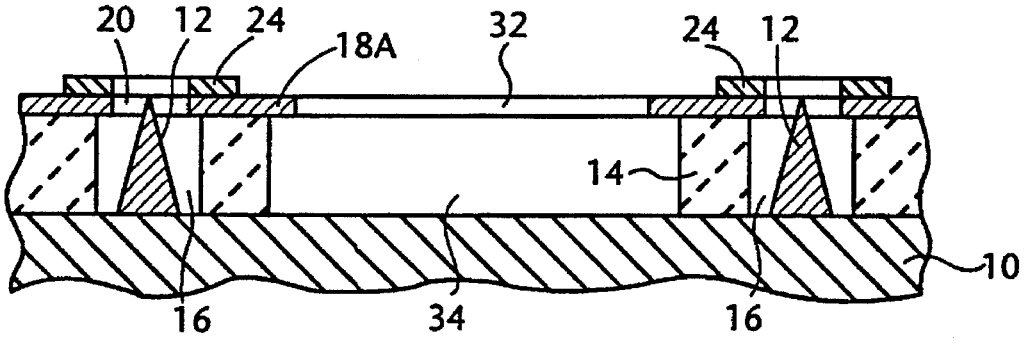
FIG. 12 shows a modification of the gate electrode in the cathode element of FIGS. 9 and 10 in a sectional view similar to FIG. 9.

In either FIGS. 7 and 8 or FIGS. 9 and 10, the uniformly thick gate electrode layer 18 may be modified to any of the three kinds of locally thickend gate electrodes shown in FIGS. 1 to 6 to thereby further reduce or relax the stresses between the gate electrode layer and the dielectric layer. For example, FIG. 11 shows the modification of the gate electrode layer 18 in FIG. 7 to the gate electrode layer shown in FIG. 1, and FIG. 12 shows the modification of the gate electrode layer in FIG. 9 to the two-layer gate electrode (18A and 24) shown in FIG. 3.

What is claimed is:

1. A field emission cold cathode element, comprising:

a substrate having a conducting surface;

a plurality of emitter electrodes each of which stands on said surface of the substrate and has a sharp-pointed tip;

a dielectric layer which is formed only on limited regions of said surface of the substrate so as to expose the substrate surface in other regions and formed with a plurality of holes such that the emitter electrodes stand in the holes, respectively; and a gate electrode layer which is formed on the dielectric layer so as to extend above the exposed regions of the substrate surface and formed with a plurality of apertures which are right above and contiguous to the respective holes in the dielectric layer, the gate electrode layer being further formed with a plurality of holes in the regions above the exposed regions of the substrate surface.

2. A cold cathode element according to claim 1, wherein each emitter electrode has a conical shape.

3. A cold cathode element according to claim 2, wherein the position of the sharp-pointed tip of each emitter electrode is above the bottom plane of the gate electrode layer.

4. A cold cathode element according to claim 1, wherein the gate electrode layer is made relatively thick in limited regions which surround said apertures, respectively, and relatively thin in other regions.

5. A cold cathode element according to claim 1, further comprising a supplementary gate electrode layer which is formed on said gate electrode layer only in limited regions which surround said apertures, respectively.

6. A cold cathode element according to claim 5, wherein said supplementary gate electrode layer is better in endurance to high temperatures than said gate electrode layer.

7. A cold cathode element according to claim 6, wherein said gate electrode layer is nearer the dielectric layer in the coefficients of linear expansion than the said supplementary gate electrode layer is to the dielectric layer.

8. A cold cathode element according to claim 7, wherein said gate electrode layer is formed of polycrystalline silicon and said supplementary gate electrode layer is formed of tungsten silicide.

* * * * *